US005762551A

United States Patent [19]

Lachapelle et al.

[11] Patent Number: 5,762,551

[45] Date of Patent: Jun. 9, 1998

[54] FREEZE-FREE VENT

[75] Inventors: Luc Michel Lachapelle, Sudbury; John Robert Davies, Markham, both of Canada

[73] Assignee: Canada Limited, Sudbury, Canada

[21] Appl. No.: 833,345

[22] Filed: Apr. 4, 1997

Related U.S. Application Data

[63] Continuation-in-part of Ser. No. 691,542, Aug. 2, 1996, abandoned.

[51] Int. Cl.[6] ..... F23L 17/00

[52] U.S. Cl. ..... 454/359; 137/512.2

[58] Field of Search ..... 454/30, 260, 347, 454/349, 352, 353, 354, 359, 363; 34/235; 137/512.2

[56] References Cited

U.S. PATENT DOCUMENTS

| | | | |
|---|---|---|---|
| 632,572 | 9/1899 | Ivens | 137/512.2 |
| 2,082,543 | 6/1937 | Hillman | 127/512.2 X |
| 4,237,621 | 12/1980 | Boisminu | 454/359 X |
| 5,167,578 | 9/1992 | Legault | 454/359 X |
| 5,344,363 | 3/1994 | Pollock | 454/359 X |
| 5,498,204 | 3/1996 | Anderson et al. | 454/359 |

FOREIGN PATENT DOCUMENTS

| | | | |
|---|---|---|---|
| 26 53 158 | 5/1978 | Germany | 137/512.2 |

*Primary Examiner*—Harold Joyce
*Attorney, Agent, or Firm*—Stanley E. Johnson

[57] ABSTRACT

A flap valve vent hood for discharging air to atmosphere from clothes dryers and bathroom vents is provided freeze-free by a secondary valve that is mounted on the principal flap valve and covering an open area that provides a secondary air flow path through the principal flap valve. The principal flap valve and the secondary valve are normally closed and the principal flap valve is biased to its closed position by gravity. A lip along an edge of the open area may be provided to minimize accumulation of moisture where the two valves are in contact with one another. A soffit vent hood of particular construction is provided in which there are two members detachably interconnected one being a downwardly directed hood and the other an insert therefor which carries the valves for respective ones of a pair of outlet discharge openings.

25 Claims, 4 Drawing Sheets

FREEZE-FREE VENT

RELATED APPLICATION

This application is a Continuation-In-Part of U.S. application Ser. No. 08/691,542 entitled FREEZE-FREE VENT filed Aug. 2, 1996, now abandoned.

FIELD OF THE INVENTION

This invention relates generally to valved ventilator hoods used on houses for discharging air from bathrooms and clothes dryers within the house to atmosphere and more particularly to an improved flap valve arrangement to overcome the problem of freezing that results in below freezing atmospheric temperatures.

BACKGROUND OF THE INVENTION

Ventilator discharge hoods are used with bathroom fans and clothes dryers to vent them to atmosphere. These conventionally are vented through a vertical wall and there is a flap valve located in a vent hood attached on the outside of the building. The flap valve is located at the end of a conduit that passes through the wall and the valve closes by virtue of gravity when there is no forced air flow through the conduit. The valve is located exteriorly of the house and is subject to freezing closed in below freezing temperatures.

Disclosed in U.S. Pat. No. 5,167,578, issued Dec. 1, 1992, is a soffit mounted ventilator and that patent, by virtue of an assignment, has been transferred to the owner of the present application. In FIG. 8 there is illustrated in the issued United States patent an embodiment in which there are dual discharges from a common hood and flap-type valves for closing respective ones of the discharge openings upstream of the openings. Applicants have found that the flap valves have a tendency to freeze closed when used in freezing temperatures and particularly extreme cold conditions. Air being discharged through the vent from a bathroom is normally of relatively high humidity resulting in a lot of condensation when the air hits the cold outside air and/or components of the valve mechanism subjected to the atmospheric cold air conditions. The condensation accumulates along the edge of the flap valve and the valve accordingly freezes shut and no longer operates as a vent. Dryer ventilators have had the same problem but they sometimes thaw out while the dryer is running because of the higher heat content in air discharged from a clothes dryer.

SUMMARY OF THE INVENTION

In order to overcome the freezing problem applicant has provided a secondary valve, on the main flap valve, that normally overlies an open area in the main flap valve. The referred to open area is preferably an aperture through the main flap valve but a notch or notches in an edge of the main flap valve could be used for the same purpose. At least some of the edges defining the opening in the main flap valve are preferably so arranged or provided with a lip so as to prevent or minimize condensation accumulating between the contact area of the secondary valve with the main flap valve. Also with the reduced size (the secondary valve is much smaller than the main flap valve) less thermal energy is required to unfreeze should any freezing occur and thus the blockage is only relatively temporary. Once the flow of air has started the main flap valve then becomes heated and thawing occurs resulting in the main flap valve opening for free discharge of the forced air to atmosphere.

There is particularly provided, in accordance with the present invention, in a flap valve ventilator mountable on an exterior surface of a building for discharging warm humid air to atmosphere from a bathroom vent fan, clothes dryer or the like in such building the improvement comprising a secondary valve mounted on said flap valve and located on a face thereof disposed downstream from the source of humid air being discharged, said flap valve having a selected open area for flow of air therethrough and wherein said secondary valve is biased to a normally closed position in which it overlies said selected open area on the flap valve when no air is being forced from within the building through said ventilator.

In another aspect of the present invention there is provided a soffit mount vent hood comprising a housing having a pair of spaced apart discharge openings, a pair of principal flap valves in said housing that are located upstream of said discharge openings, said valves being biased to a normally closed position to prevent back flow of air and a secondary valve mounted on each of respective ones of said pair of principal flap valves, said secondary valves being located on a downstream side of the principal valve associated therewith with respect to air forced to flow through the ventilator during in situ use thereof, said secondary valves permitting air flow through respective ones of the principal flap valves when the latter are frozen shut.

LIST OF THE DRAWINGS

The invention is illustrated by way of example with reference to the accompanying drawings wherein.

DESCRIPTION OF THE PREFERRED EMBODIMENT

Figure 1:
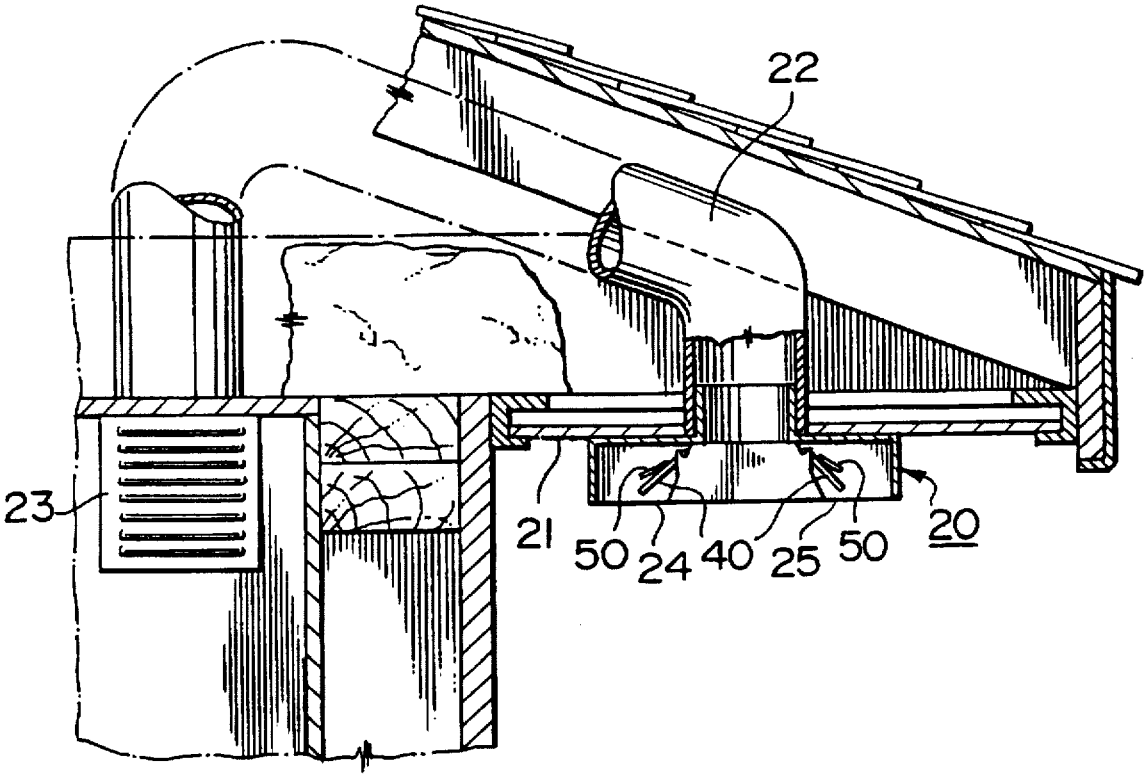
FIG. 1 is a sectional view through a portion of a building structure illustrating a clothes dryer vent hood mounted on the outer vertical wall and a bathroom exhaust fan vent hood mounted on the soffit.
Figure 1:
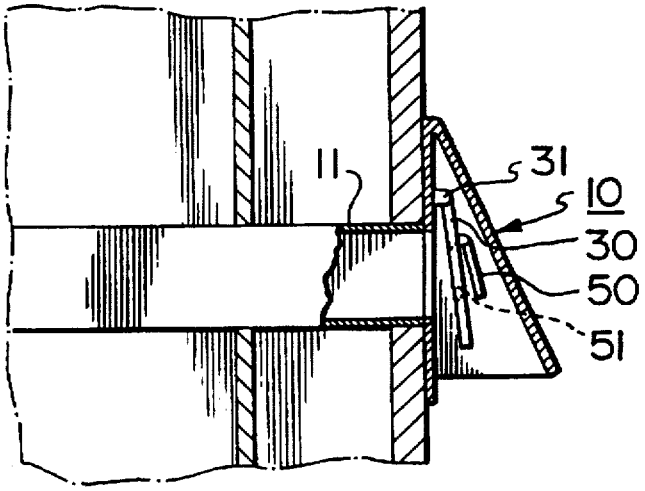
Figure 2:
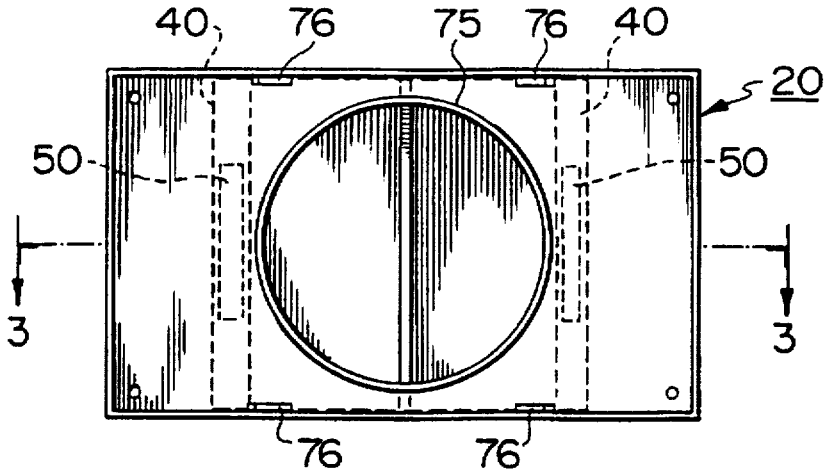
FIG. 2 is a top plan view of the soffit mounted vent shown in FIG. 1.

Referring to FIG. 1 there is illustrated a portion of a building structure on which there is a valved vent hood 10 mounted on the outer surface of a vertical wall for venting to atmosphere a clothes dryer through a discharge conduit 11. Also shown in FIG. 1 is a valved vent hood 20 mounted on the soffit 21 of the building for discharging air from a bathroom vent fan 23 by way of conduit 22 to atmosphere. A valved vent hood mounted on a soffit is the subject of the aforementioned U.S. Pat. No. 5,167,578.

In each of the ventilators 10 and 20 there is provided valve means to prevent backflow of air into the building through the conduits. These backflow preventing valves close by gravity and in each instance is a pivotally mounted flap or door. The flap is disposed vertically or generally vertically and is suspended from a hinge means in which the hinge or pivot mounting means is located normally at an elevation higher than the outlet opening that the valve closes and the free outer end of the flap, remote from the pivoted end, is located at an elevation lower than the discharge opening that the valve closes. The flap valve is biased to a normally closed position by virtue of gravity and a positive force in the closed position may be provided by sloping the valve relative to a vertical plane.

With reference to FIG. 1 the valved vent 10 has a flap valve 30 pivotally attached as at 31 to an inner wall of the hood. The hood attaches to the conduit 11 by a collar or a short sleeve or any other convenient means. The valved vent 20 differs from vent 10 by being mounted on the soffit and it has two discharge outlets designated respectively 24 and 25. Backflow through outlets 24 and 25 is prevented by respective ones of a pair of flap valves 40.

The flap valves 30 and 40 may be variously shaped in outline configuration to match the outline of the discharge opening which they close by overlying the same in the closed position. The valves close by gravity and as far as shape is concerned the vent dryer outlet conduit 11 normally would be circular as would also then be the outline configuration of the flap valve 30. On the other hand the flap valve 40 for the vent hood 20 is rectangular. While exact outline shape is not important it is to be understood that suitable shaping and outline configuration should be appropriate with respect to the opening the valve is to close.

In accordance with the present invention the flap valves 30 and 40 have mounted thereon a secondary valve 50 for closing an open area in the flap valve such as an aperture or through hole 51 in the body of the main flap valve. The secondary valve covers only a portion of the area of the main flap valve.

Figure 6:
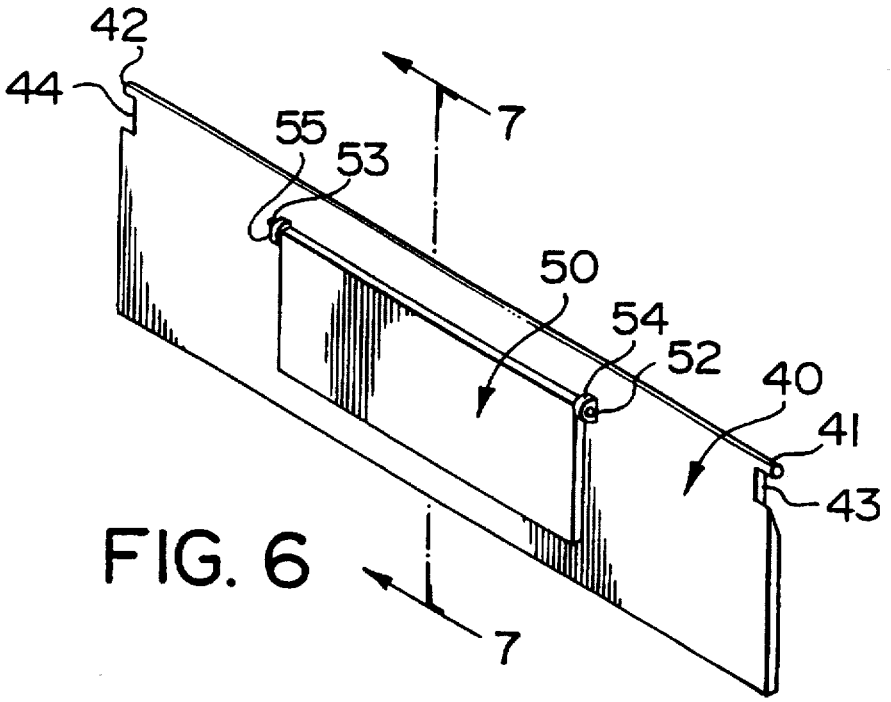
FIG. 6 is an oblique view of a flap valve for the ventilator shown in FIGS. 2 and 3.

Referring to FIG. 6 the secondary valve 50 is a flap valve pivotally attached at its upper end by outwardly oppositely directed pins or axles 52 and 53 projecting into apertures in respective lugs 54 and 55 secured to the main flap valve. As will be seen hereinafter the apertures may be oblong in a horizontal direction to provide a sliding pivot.

Figure 7:
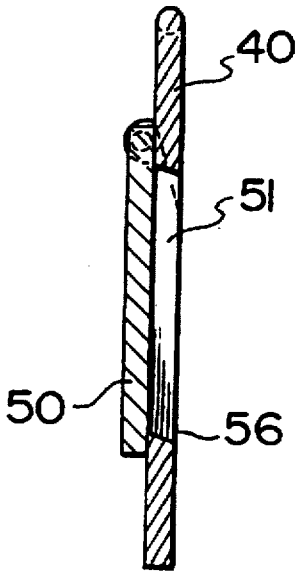
FIG. 7 is a sectional view taken along line 7—7 of FIG. 6.

A further feature of the secondary flap valve 50 is illustrated in FIG. 7 and that is the slope of the face of the lower horizontal edge 56 of opening 51. The face of the bottom edge slopes in a direction downwardly and away from the secondary flap valve 50 allowing for drainage of any condensation that might occur.

Figure 8:
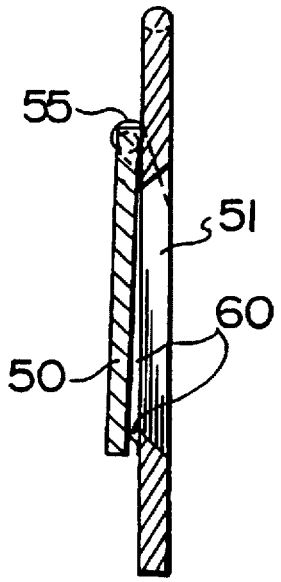
FIG. 8 is a view similar to FIG. 7 but illustrating an optional rib on the main flap valve for contact with the secondary flap valve.
Figure 9:
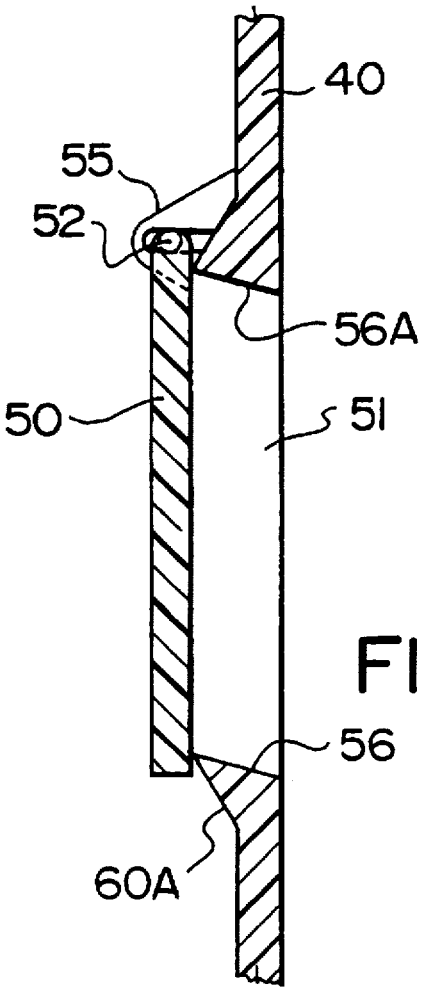
FIG. 9 is a view similar to FIG. 8 but illustrating, on a larger scale, a preferred rib on the main flap valve that circumscribes the hole therethrough.

To minimize contact between valve members 40 and 50 (or 30 and 50 as the case may be) a rib 60, shown in FIG. 8, may be provided around at least a portion of the aperture 51 or a rib 60A, shown in FIG. 9, that extends around the perimeter of the aperture 51. In FIG. 8 the rib 60 actually extends along the two vertical edges of the opening and along the bottom horizontal edge. The rib 60 preferably provides a line contact with the flap valve member 50.

In FIG. 9 there is illustrated, on a larger scale, a rib 60A that circumscribes the opening 51 in the main flap 40. The main flap 40 has a thickness of about *for example 0.080" and the rib 60A projects approximately 0.040" from a face of such flap. The secondary flap member 50 is made of propylene and has for example a thickness of 0.060". The lower edge 56 of the opening has a planar face that slopes at an angle of approximately 60° to the plane of the face of the member 40. The rib 60A has an outer planar face below the edge 56 that slopes about 60° from a plane perpendicular to the face of the member 40. The top edge of the opening, designated 56A, has a face that also slopes as seen from FIG. 9. The flat faces of edges 56 and 56A are in planes that slope in a direction downwardly away from the secondary flap member 50 with reference to the main flap member in its operative position.

Figure 3:
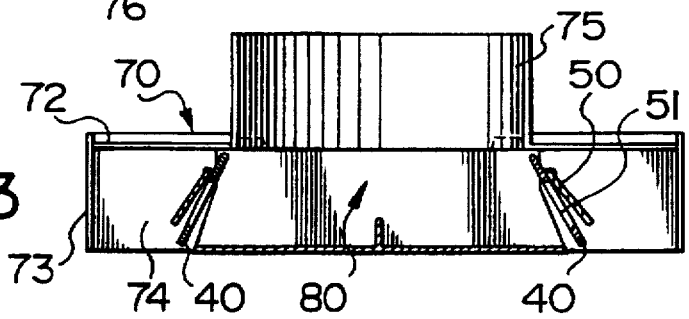
FIG. 3 is a sectional view taken essentially along line 3—3 of FIG. 2.
Figure 4:
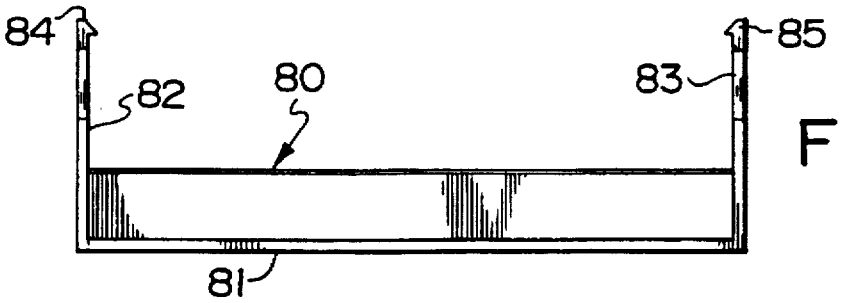
FIG. 4 is an end elevational view of an insert portion of the vent hood shown in FIGS. 2 and 3.
Figure 5:
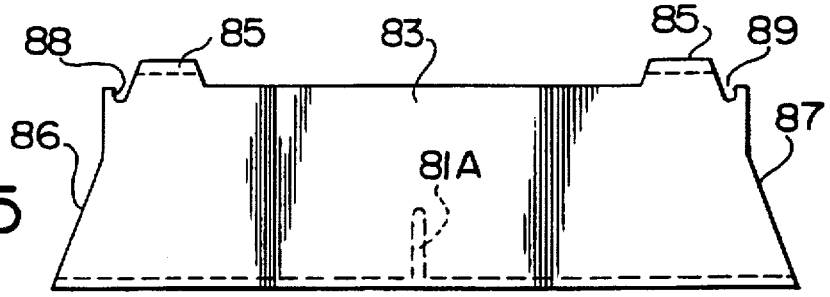
FIG. 5 is a side elevational view of FIG. 4.

As apparent from FIG. 3 the main flap valves 40 are inclined relative to the vertical when in their closed position and the secondary flap valves 50 are on the high side of the main flap valve associated therewith. This provides a positive bias (by gravity) to a valve closed position for each of the main valve 40, and secondary flap valve 50 associated therewith. The high side referred to is also the downstream side with reference to air caused to flow through the ventilator.

The foregoing dimensions are by way of example only and are with respect to a main flap valve 40 that measures approximately 4.56"×1.460" and wherein the secondary flap valve 50 thereon is approximately 2"×0.75". With these dimensions the face area of the secondary flap 50 is about 22.5% of the face area of the main flap 40 on which it is mounted.

Figure 10:
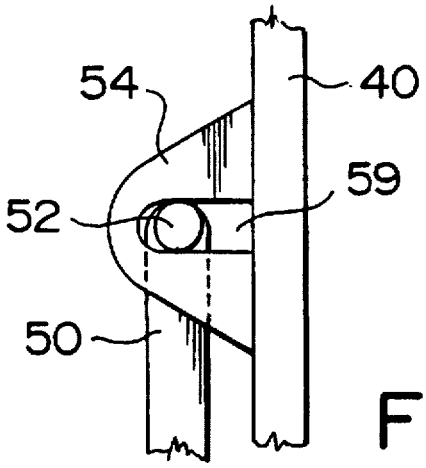
FIG. 10 is a side view illustrating one of the pivot mountings for the secondary flap valve.

FIG. 10 illustrates lug 54 on the main flap 40 such lug being one of the two lugs that along with axles 52, 53 pivotally mount the secondary flap member 50 on the principal flap member 40. The lug 54 has an oblong slot (or depression) 59 for receiving the axle 52. Similarly lug 55 has an oblong slot (not shown) for axle 53. The oblong slot and axle effectively is a sliding pivot connection and this ensures complete contact of the secondary flap member 40 with the rib 60A that extends around the perimeter of the opening 51.

The additional auxiliary flap valve 40 minimizes or eliminates the likelihood of the vent freezing closed during severe below freezing temperatures.

In accordance with another aspect of the present invention there is illustrated a preferred construction of the vent hood 20.

The vent hood 20 comprises detachably interconnected moulded plastics members 70 and 80 with the valve members 40 hingedly mounted on member 80. The member 70 comprises a hood portion provided by a plate member 72 that attaches to the soffit and a peripheral wall 73 that projects downwardly and together provide a cavity 74. A spigot 75 projects upwardly from member 72 for connecting the vent pipe 22 thereto.

The moulded plastics member 80 has a bottom wall 81 and a pair of side walls 82, 83 projecting upwardly therefrom, on the upper edge of sidewall 82 there are a pair of lugs 84 and similar a pair of lugs 85 at the top end of a wall 83. The lugs pass through apertures 76 in wall 72 providing a snap-fit quick connect detachably anchoring of member 80 to member 70.

The sidewalls 82 and 83 each terminate at one end in a sloped portion 86 and at the other end in an oppositely sloped portion 87. These sloping edges provide abutments for the pair of main flap valves 40. Above the sloped portions 86 and 87 are respective notches 88 and 89. The pair of notches 88 (one in each of walls 82 and 83) provide a pivotal connection for pins 41 and 42 of one of the main flap valves 40. Similarly the pair of notches 89 provide a pivoted mounting for the other flap valve 40. Below the pins 41 and 42 on the flap valve there are respective notches 43 and 44 for receiving therein a portion of end edges of the vertical walls between the sloped lower portion and the notch.

The lower wall 81 of the member 80 has an upwardly projecting rib 81A acting as an air flow divider between the outlet discharges 24 and 25 and it also is a strengthener of wall 81.

The pair of valve members 40 are readily suspended from member 80 by placing pins 41 and 42 in one instance in the pair of notches 88 and in the other instance in the pair of notches 89 for the respective flap valves. The member 80, with the pair of valves 40, is then placed in the cavity 74 and lugs 84 and 85 pushed into apertures 76 in the plate member 72. The lugs have a hook portion for retaining the members 70 and 80 together. With the members joined together the valves are locked in the notches 88 and 89 by the plate 72. The valves 40 abut the sloped edges 86, 87 as the case may be providing a pair of primary valved outlets and each valve has the secondary valve 50 thereon.

In the foregoing vents the raised lip on the main flap member around the opening therein makes line contact with a face of the secondary flap member 50 and reduces the surface that can freeze. The secondary flap valve door is preferably made of polypropylene or polyethylene which is resistant to ice adhesion. The opening is angled so that condensing moisture is diverted away from the secondary flap. The upper edge in the FIG. 9 embodiment is angled to act as a drip rail diverting water that is sliding down the main flap valve and the lower surface is angled to take any moisture off the secondary flap and divert it back to the principal flap valve.

Various modifications will be obvious to those skilled in the art keeping in mind that the primary function of the secondary valve is to allow air flow in the event the principal valve freezes shut. The preferred design accordingly is such as to minimize or prevent moisture build up at the point of contact between the secondary flap valve and the principal flap valve on which it is mounted.

In the foregoing preferred embodiment there has been described a secondary flap valve which is pivotally mounted on the downstream face of the principal flap valve. Rather than having the secondary flap valve pivotally mounted on the principal flap valve the same function might be provided by flexing of the secondary valve. For example the secondary flap valve could be a sheet or film piece joined by suitable means along an edge thereof to the main flap valve. The joining means and/or a predetermined flexibility of such piece may be such as to permit the valve to move to an open position when air is forced to flow against the principal valve when the principal valve associated therewith is frozen shut. Also disclosed hereinbefore is a hole through the principal valve with such hole being covered by the secondary valve. In place of a hole there may be a notch or notches in an edge or edges of the principal valve which is/are covered by the secondary valve. Various modifications will readily occur to those skilled in the art.

We claim:

1. In a ventilator mountable on the exterior surface of a building for discharging warm humid air from within the building through a principal flap valve to atmosphere and in which such principal flap valve is biased by gravity to a closed position the improvement comprising an aperture through said principal valve for flow of air therethrough and a secondary flap valve pivotally mounted on said principal flap valve and located on a face thereof disposed downstream from the source of humid air to be discharged, said secondary flap valve being biased by gravity to a normally closed position covering said aperture when no air is being forced from within the building through said ventilator.

2. The improvement as defined in claim 1 wherein said aperture is defined at least along the bottom thereof by an edge having a face sloping in a direction downwardly and away from said secondary flap member.

3. The improvement as defined in claim 1 including a rib projecting from said principal flap valve around at least a portion of said aperture, said rib providing a seat engaged by a face of said secondary flap valve.

4. The improvement as defined in claim 3 wherein said seat comprises a narrow edge on said rib providing line contact with said secondary flap.

5. The improvement as defined in claim 4 wherein said rib extends around the perimeter of said aperture through the principal valve.

6. A soffit mount vent hood comprising a housing having a pair of spaced apart discharge openings, an inlet to said housing for connecting thereto a conduit from a forced air vent system, a pair of principal flap valves located in said housing at a position upstream of said discharge openings for closing, by gravity, flow of air in a direction from said discharge openings to said inlet, an aperture through each of said principal flap valves and a secondary flap valve pivotally mounted on each of respective ones of said pair of principal flap valves and located downstream of said inlet, said secondary flap valves covering the apertures in the principal valve associated therewith and permitting forced air flow through respective ones of the principal flap valves, when the latter are frozen shut, in a direction from said inlet to said discharge openings.

7. A soffit mount vent hood as defined in claim 6 wherein said housing comprises a first housing member with a cavity therein, a second member insertable into said cavity and wherein said pair of principal flap valves are pivotally mounted on said second member.

8. A soffit vent hood as defined in claim 6 wherein said housing comprises a first housing member having a cavity therein, an air inlet to said cavity, a second member insertable into said cavity and having a wall extending from one of said discharge openings to the other to partially extend across a mouth of said cavity and thereby define said discharge openings and wherein said pair of principal flap valve members are pivotally mounted on said second member.

9. A soffit mount vent hood as defined in claim 6 wherein said housing comprises a first housing member having a first wall with a spigot projecting from one face thereof for attaching a vent system conduit thereto and a peripheral wall projecting from the opposite face, said peripheral wall and first wall providing a cavity, a second member insertable into said cavity and having a bottom wall with opposite ends thereof spaced from said housing peripheral wall providing said spaced apart discharge openings, said second member having a pair of spaced apart side walls projecting from said bottom wall in a direction toward said first housing member first wall, said walls having respective opposite ends, means anchoring said second member to said first housing member and wherein said pair of principal flap valves are pivotally attached to said second member with said opposite ends of the side walls providing seats for said principal valves.

10. A soffit mount vent hood as defined in claim 9 wherein said seats for said principal valves are in respective ones of a pair of inclined planes that diverge in a direction downwardly away from one another with reference to such vent hood in situ on a soffit.

11. A soffit mount vent hood as defined in claim 9 wherein said side walls of said second member are detachably secured to said first housing member.

12. A soffit mount vent hood as defined in claim 11 wherein said side walls of said second member have projections thereon extending through apertures in said first wall of said first housing member.

13. A soffit mount vent hood as defined in claim 12 wherein said projections have a hooked end providing a snap fit detachable interconnection with said first wall.

14. A soffit mount vent as defined in claim 6 wherein the aperture through principal flap valve is surrounded at least along a lower and opposite side edges thereof by a rib projecting outwardly from a face of the principal flap valve engaged by the secondary flap valve associated therewith.

15. A soffit mount vent hood as defined in claim 14 wherein said rib completely surrounds the aperture and wherein each said secondary flap valve is suspended by a sliding pivot means.

16. A soffit mount vent hood as defined in claim 15 wherein said rib has a narrow outer edge providing line contact with the secondary flap valve associated therewith.

17. In a ventilator mountable on the exterior surface of a building for discharging warm humid air from within the building through a principal flap valve on such ventilator to atmosphere and in which such principal flap valve is biased by gravity to a closed position the improvement comprising a predetermined open area on a portion of said principal valve permitting flow of air therethrough, a secondary valve and means mounting said secondary valve on said principal flap valve, said secondary valve being located on a face of said principal valve disposed downstream from the source of humid air to be discharged, said secondary valve being biased to a normally closed position covering said predetermined open area when no air is being forced from within the building through said ventilator and caused to open by air flow forced against a malfunctioning principal valve.

18. The improvement as defined in claim 17 wherein said open area comprises an aperture.

19. The improvement as defined in claim 17 wherein said secondary valve comprises a flap valve and wherein said mounting means comprises a pivotal mounting.

20. A vent hood for a forced air ventilating system comprising a housing, flange means on said housing for mounting said housing on an exterior surface of a building, a principal flap valve, means pivotally mounting said principal flap valve on said housing and suspending it from an upper end thereof so as to close by gravity when the ventilator is mounted in situ, said principal valve being located in an air passageway through said housing and biased normally to a closed position preventing back flow of air therethrough into said ventilating system, said principal valve opening automatically in response to air being forced to flow through said housing from said ventilating system and wherein said principal valve has a secondary air passageway therethrough and a secondary normally closed valve covering said secondary air passageway, said secondary valve being located on a downstream side of said principal valve.

21. A vent hood as defined in claim 20 mountable on the soffit of a building and wherein said mounting flange means and housing are integrally formed.

22. A soffit mount vent hood through which warm humid air, from within a building, is discharged, by a forced air system, to atmosphere, said vent hood comprising a housing securable to the soffit of a building, a pair of principal flap valves mounted on said housing, said principal valves being biased by gravity to a normally closed position when said vent hood is located in situ, a valve seat on said housing for each of a respective one of said pair of principal valves, said valves engaging their respective valve seat when the valve is in a closed position and in which position said valves prevent back flow of air, through said housing, from atmosphere to said forced air vent system, a secondary air flow passageway through at least one of said pair of principal valves and a secondary valve mounted on said at least one principal valve, said secondary valve being located on a downstream side of the principal valve associated therewith and biased to a normally closed position covering said secondary air flow passageway.

23. A soffit mount vent hood as defined in claim 22 in which there is a secondary valve on each of the respective principal valves and wherein said seats for said principal valves are in respective ones of a pair of inclined planes that diverge in a direction downwardly away from one another with reference to such vent hood in situ on a soffit.

24. A vent hood as defined in claim 22 including a baffle in said housing diverting air flow to respective ones of said pair of principal valves.

25. In a building having a room ventilating system comprising a power driven forced air unit with an air inlet communicating with an area to be ventilated and an exhaust outlet, a vent hood mounted on the soffit of said building and conduit means extending from said exhaust outlet to said vent hood so as to discharge air from said power driven unit through said vent hood to atmosphere, said vent hood having an air flow inlet area communicating with said conduit means, a pair of outlets spaced apart from one another downstream from said inlet, a normally closed flap valve between said inlet and each of a respective one of said outlets, said valves preventing air from atmosphere entering the power driven unit when such unit is not in use, means pivotally mounting said valves whereby they open automatically by air caused to flow by said power driven forced air unit through said vent hood and a secondary valve mounted on each of respective ones of said principal valves, said secondary valves being biased to a normally closed position closing a secondary air flow passage through the principal valve associated therewith.

* * * * *